US010529207B1

(12) United States Patent
Yang

(10) Patent No.: US 10,529,207 B1
(45) Date of Patent: Jan. 7, 2020

(54) EAS DEVICE WITH ELASTIC BAND

(71) Applicant: Xiao Hui Yang, Saratoga, CA (US)

(72) Inventor: Xiao Hui Yang, Saratoga, CA (US)

( * ) Notice: Subject to any disclaimer, the term of this patent is extended or adjusted under 35 U.S.C. 154(b) by 0 days.

(21) Appl. No.: 16/242,307

(22) Filed: Jan. 8, 2019

(51) Int. Cl.

| | |
|---|---|
| ***G08B 13/24*** | (2006.01) |
| ***E05B 73/00*** | (2006.01) |
| ***G08B 13/14*** | (2006.01) |
| *E05B 45/00* | (2006.01) |

(52) U.S. Cl.
CPC ..... *G08B 13/2434* (2013.01); *E05B 73/0029* (2013.01); *G08B 13/1463* (2013.01); *G08B 13/2448* (2013.01); *E05B 45/005* (2013.01)

(58) Field of Classification Search
CPC ..... G08B 13/2434; G08B 13/1463; G08B 13/2448; E05B 73/0029; E05B 45/005
USPC ..... 340/572.9
See application file for complete search history.

(56) References Cited

U.S. PATENT DOCUMENTS

| | | | | |
|---|---|---|---|---|
| 5,794,464 | A | 8/1998 | Yeager et al. | |
| 6,092,401 | A | 7/2000 | Sankey et al. | |
| 7,162,899 | B2 * | 1/2007 | Fawcett | E05B 45/005 242/382 |
| 7,215,250 | B2 * | 5/2007 | Hansen | E05B 73/0017 340/572.8 |
| 7,948,381 | B2 * | 5/2011 | Lindsay | G06K 19/0717 340/539.11 |
| 7,984,629 | B2 | 7/2011 | Xiaobin | |
| 8,274,391 | B2 | 9/2012 | Yang | |
| 8,281,626 | B2 | 10/2012 | Conti et al. | |
| 8,305,219 | B2 | 11/2012 | Yang | |
| 8,368,543 | B2 | 2/2013 | Yang | |
| 8,373,565 | B2 | 2/2013 | Yang | |
| 8,487,769 | B2 * | 7/2013 | Lindsay | G06K 19/0717 340/539.11 |
| 8,528,372 | B2 | 9/2013 | Nilsson | |
| 8,640,509 | B2 | 2/2014 | Will | |
| 8,773,267 | B2 | 7/2014 | Conti et al. | |
| 8,800,330 | B2 | 8/2014 | Fawcett et al. | |
| 8,938,997 | B2 | 1/2015 | Piccoli et al. | |
| 8,952,816 | B2 | 2/2015 | Sankey et al. | |
| 8,960,634 | B2 * | 2/2015 | Le Gette | F16M 11/04 248/163.1 |
| 9,169,670 | B2 * | 10/2015 | Shute | E05B 45/005 |
| 9,500,009 | B2 | 11/2016 | Sankey et al. | |
| 10,066,422 | B2 * | 9/2018 | Yang | E05B 73/0029 |
| 10,121,340 | B2 * | 11/2018 | Yang | G08B 13/2448 |

* cited by examiner

*Primary Examiner* — John A Tweel, Jr.
(74) *Attorney, Agent, or Firm* — Brian W. Foxworthy; Robert R. Waters; Waters Law Group, PLLC

(57) ABSTRACT

An electronic article surveillance apparatus for monitoring boxes and other items comprises a base, an electronics housing, and an elastic band. The base has posts and spring loaded pins proximal to the posts. The elastic band has two ends and an aperture at each end. The electronics housing has apertures that align with the spring loaded pins and that give access to switches within the housing. When the base is installed on an item and the elastic band is wrapped around the item with its apertures over the posts, the band restrains the spring loaded pins. When the housing is installed on the base, the band keeps the pins from actuating the switches. If the band has its tension relaxed, by tampering for example, the band ceases to restrain the pins which then actuate the switches. The electronics monitor the switches for tampering and can signal alarms.

20 Claims, 9 Drawing Sheets

EAS DEVICE WITH ELASTIC BAND

FIELD OF INVENTION

The present application is generally related to an electronic article surveillance (EAS) device. More specifically, the present application relates to an EAS device that uses at least one elastic band to monitor attachment of the EAS device to a box or other item.

BACKGROUND OF THE INVENTION

Theft in retail establishments is a consistent problem. There are numerous systems for preventing theft. In general, the systems consist of setting up an electronic article surveillance (EAS) monitoring system of antennas, computers, etc. for an area that is to be controlled. Electronic article surveillance (EAS) devices are attached to objects that are desired to be protected. In their simplest embodiments, the EAS devices comprise passive EAS elements that are capable of generating response signals when exposed to interrogation fields.

The interrogation fields are frequently established at exits. The interrogation fields are generated intermittently. When a passive EAS element is in an active interrogation field, the interrogation field generates energy in the passive elements. When the interrogation field turns off, this energy dissipates and generates a signal. The EAS system monitors for signals while the EAS interrogation field is off. If a signal is detected by the EAS system, the EAS system evaluates that signal as indicating that an EAS device, and the item to which it is attached, is in the zone monitored by the interrogation field. The EAS system may then generate an alarm. Through convention and regulation, EAS systems operate at discrete common frequencies.

More sophisticated EAS devices may have elements of memory and logic. These more sophisticated devices can store information, communicate information with the EAS system, be reprogrammed, monitor the integrity of the EAS device, etc. There are a wide variety of methods of attaching EAS devices to a product that is desired to be protected from theft. Both the attaching method and the communication system of an EAS device may be attacked to effect the theft of an item.

Some EAS devices are attached to a box or carton containing a product by elements that wrap around the box. These wrapping elements may be permanently a part of the EAS device, or they may be separable elements and disposable. The rest of the EAS device is reusable with the supply of new wrapping elements to attach the EAS device to the next box.

RELEVANT ART

U.S. Pat. No. 7,522,048 by Belden, Jr. is for "BANDING CLIP ALARM". A security alarm is removably attached to a band extending about a package which sounds an alarm should tension on the band be reduced, to prevent theft of the package contents. The band extends through a passage formed between the bottom of an alarm housing and a bottom lock plate pivotally connected to the housing. A plunger switch is mounted in the housing and engages the band. Reduction of the band tension permits the switch plunger to move and actuate an audible alarm. A slide lock attaches the bottom lock plate to the alarm housing to prevent removal of the alarm from the band. A key unlocks the slide lock from the alarm housing enabling the alarm to be slid from beneath the band.

U.S. Pat. Nos. 8,305,219 and 8,368,542 by Yang are for "EAS tag using tape with conductive element". An electronic article surveillance apparatus for monitoring large objects is comprised of a base, at least one segment of tape, and an electronics housing. The segment of tape has at least one electrically conductive element running the length of the tape. The base rests on an object to be monitored, and the housing releasably latches onto the base, while each tape segment wraps around the object with each end of tape segment being fixed between the base and housing. Electronics within the housing complete a circuit through each tape segment and monitors the tape segments for electrical continuity. If electrical continuity is lost, either by cutting a tape segment, or unauthorized unlatching of the housing, an alarm can be sounded by the electronics within the housing. The electronic housing may be disarmed by a remote device and unlatched from the base. Both base and tape segments may have adhesive elements.

U.S. Pat. No. 8,373,565 by Yang is for "Security apparatus with conductive ribbons". An electronic article surveillance (EAS) security apparatus is comprised of a housing, base plate, ribbon pad, and electrically conductive ribbons. In one embodiment, the ribbons are pre-attached to the ribbon pad and extend from the ribbon pad. The ribbon pad and base plate are installed on opposite sides of an object to be protected. The ribbons are extended around the object, and their extended ends attached to the base plate. The housing has electrical contacts and encloses electronics and is attached to the base plate so that the electrical contacts complete circuits through the ribbons. The electronics in the housing monitors the ribbons to detect unauthorized removal of the apparatus. A switch on the bottom of the housing detects that the housing is attached to a plate and object. The apparatus has a locking mechanism to maintain the housing and plate together, which can be released by application of a magnet.

U.S. Pat. No. 9,404,291 by White, et al. is for "DEVICE AND METHOD FOR AN ALARMING STRAP TAG". In White, a security device may include a rotatable cap and an engagement member. The cap may be graspable by an operator during attachment of the security device to at least a first strap extending substantially around a portion of an object. The engagement member may be configured to engage the first strap. The engagement member may also be substantially fixed in relation to the cap during the attachment of the security device to the first strap and the engagement member may be rotatable with the cap. The security device may be transitioned to a locked state responsive to rotational engagement of the engagement member with the first strap. The rotational engagement of the engagement member with the first strap may also increase tension on the first strap.

SUMMARY OF EMBODIMENTS OF THE INVENTION

Embodiments of the present electronic article surveillance (EAS) device have an electronics housing, a base, and an elastic band. The base attaches to an item to be protected. The elastic band has two ends and wraps around the item to be protected and each end attaches to the base. The housing attaches to the base. Complementary attaching elements on the base and housing allow the housing to be mounted to the base. In some embodiments, a sliding latch in the housing engages elements on the base to attach the housing to the base. The housing has apertures in its bottom through which switches within the housing may be accessed. The base has spring loaded pins on its top surface that align with the apertures. When the housing is attached to the base, and the elastic bands are in place, the elastic bands restrain the spring loaded pins from contacting the switches within the housing. The elastic band monitors the continued attachment of the EAS device to the item. If the elastic band is tampered with, such as being cut, torn, or removed from the item, the elastic band loses sufficient tension to restrain the spring loaded pins. The spring loaded pins can then contact the switches within the housing, and electronics within the housing can detect the change in state of the switch. The electronics within the housing may then determine an alarm condition is present and trigger an alarm. In some embodiments, the elastic bands are how the EAS device is maintained on the item. In other embodiments, another method is used to secure the EAS device to the item, and the elastic band only serves to monitor the continued attachment of the EAS device to the item.

In addition to switches within the housing that are accessible through apertures, the housing may also have a switch extending through its bottom. An aperture in the base aligns with the switch when the housing is installed on the base and the switch extends through the base as well. This switch extending from the housing and through the base contacts the item to which the EAS device is attached. This changes the state of the switch. Once the EAS device is attached to an item, the electronics within the housing monitors this switch to detect forced removal of the EAS device from the item.

The electronic housing of the EAS device may have several components within it, including: a microprocessor, a circuit board, a battery, an EAS core and coil element, the switches referenced above, an audible alarm producing device, an infrared communication port or other communication elements, and a light emitting diode. The microprocessor or circuit board can detect the state of the switches and other circuit elements. The microprocessor or circuit board executes machine executable instructions based on these inputs to determine whether the EAS device has been installed, whether to arm, whether the elastic bands have been tampered with, whether an alarm condition exists, and how to respond to a given set of states. When initially installed on an item, the EAS device may be armed with an external arming device that communicates with the device via the infrared communication port, radio frequency communications, or other communication elements, or the electronics may arm based simply upon installation of the EAS device on an item.

Once an EAS device is assembled and armed, unauthorized removal of the device is detected by the onboard electronics which sense an alarm condition via changes in state of any conditions required to arm the EAS device, such as changes to the switches. In one case, if the EAS device is removed from an item, the switch extending from the housing will lose its contact with the item to which the EAS device is attached. In another case, if the elastic bands are severed or otherwise relaxed, the spring loaded pins will contact the switch internal to the housing. In either case, the change in state of the switches will indicate an alarm condition exists. In response to a detected alarm condition, the electronics can generate an alarm, including onboard audible alarms, or alarms communicated to the EAS system via infra red signals, radio frequency signals, or other communication methods.

Disarming of the EAS device may be accomplished by authorized personnel. An authorized person having access to other elements of the EAS system such as a hand held communication device or a base station having communication capabilities may disarm the device. Some embodiments will add another element of security with passcode capabilities in the respective electronics. The EAS device electronics of these embodiments are capable of storing a passcode which is known to the communication elements of the EAS system and which can be used to confirm to the EAS device that the disarming signal is authorized. If an EAS device is detached without being disarmed with the appropriate passcode, the EAS device will detect an alarm condition and generate an alarm.

To physically prevent the detaching of the housing from the base, a blocking component or mechanism may be employed to prevent the disengagement of the complementary attaching elements of the housing and base. In one embodiment, a biased blocking member moves into a blocking position when the complementary attaching elements are engaged as the EAS device is installed. In one embodiment, a latch engages between the housing and the base, and a biased blocking element moves into position to prevent the disengagement of the latch. In one embodiment, the biased blocking member has a magnetically attractable element associated with it, and when a magnet is applied to the EAS device, the biased blocking member moves to a position where it no longer blocks the release of the complementary attaching elements. If a magnet is used to detach an EAS device without authorization and the EAS device is still armed, the electronics detect an alarm condition and generate an alarm. In some embodiments, a magnet may be built into a communication device so that the EAS device may be disarmed and its latch released for detachment using the same device.

Some embodiments may employ supplementary means to attach the EAS device to an item to be protected. This may include adhesive on the base which provides a means of initially fixing the base in place on an item. The elastic bands and housing may then be attached to the base.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
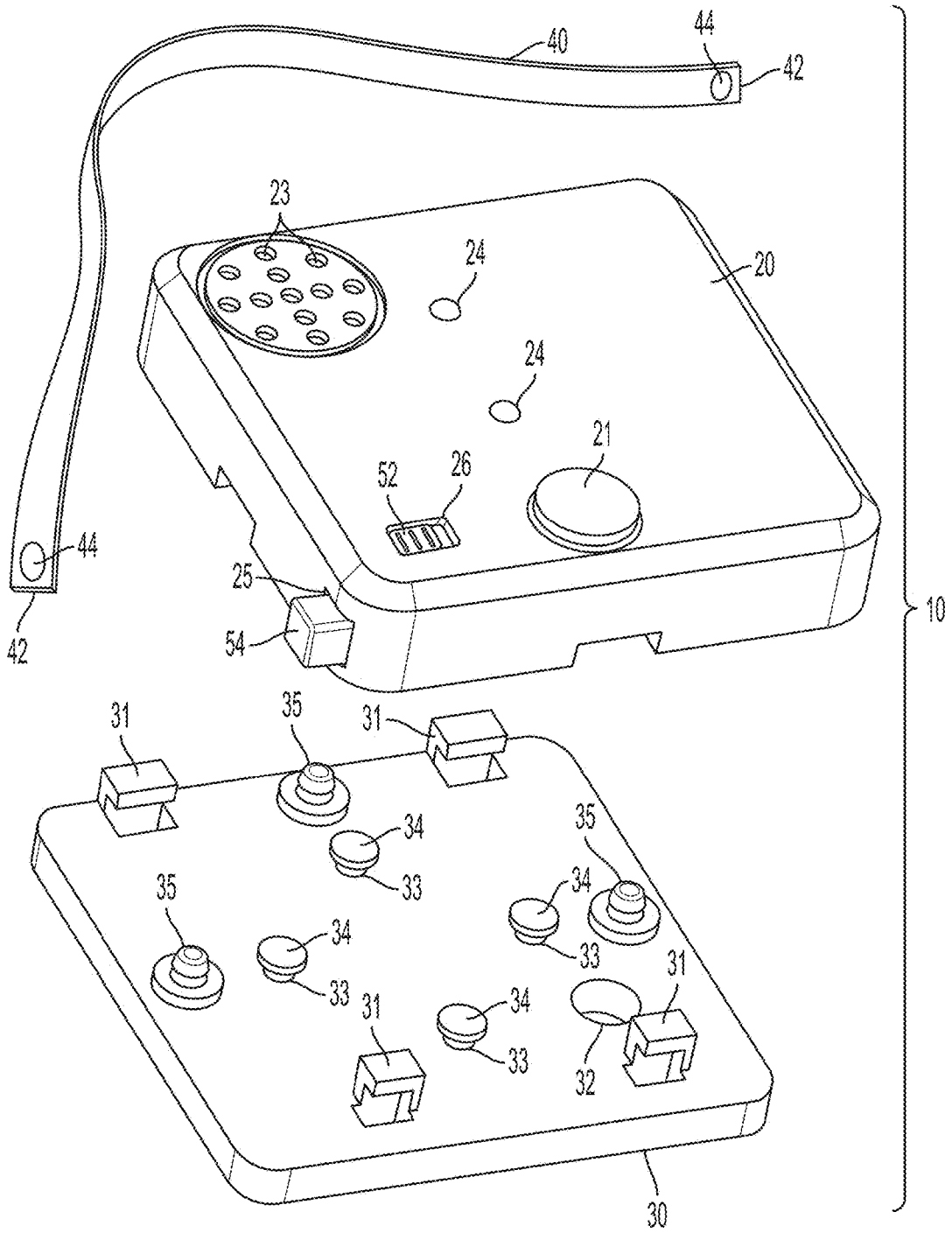
FIG. 1 is a top perspective view of the housing, base, and elastic band of an embodiment of an EAS device.

FIG. 1 is a top perspective view of the housing 20, base 30, and elastic band 40 of an embodiment of an EAS device 10. Elastic band 40 has two ends 42, each end 42 having an aperture 44 through it. Base 30 has posts 33 topped with caps 34. The size of apertures 44 and the elasticity of elastic band 40 allow apertures 44 to fit over caps 34 onto posts 33. Base 30 is placed on an item, such as a box. Elastic band(s) 40 are wrapped around the item, and caps 34 and posts 33 are inserted through apertures 44 at ends 42 of elastic band 40. Once elastic band 40 is installed on posts 33, caps 34 maintain elastic band 40 on posts 33. In some applications, the flexibility of elastic bands 40 allow quick attachment of base 30 while also maintaining base 30 in position.

Proximal to posts 33, base 30 has spring loaded pins 35 extending upward from its top surface. When elastic bands 40 are attached to base 30 on an item, spring loaded pins 35 are compressed, or restrained, by elastic bands 40. As will be discussed below, this compression of spring loaded pins 35 prevents pins 35 from actuating switches as long as elastic bands 40 are in place.

In addition to posts 33 and spring loaded pins 35, base 30 has mounting hooks 31 and switch aperture 32. Mounting hooks 31 interface with complementary attaching elements of housing 20 to attach housing 20 to base 30. Switch aperture 32 aligns with a switch that extends from the bottom of housing 20.

Still referring to FIG. 1, housing 20 has several features visible on its top surface. Sound apertures 23 allow sounds produced within housing 20 to be more audible. Optical apertures 24 allow exposure of optical elements of the electronics within housing 20. Button aperture 25 and slide aperture 26 expose features of a sliding latch located within housing 20 to allow manipulation of the latch, while dome 21 provides a target for the application of a magnet to housing 20 to release the latch.

Figure 2:
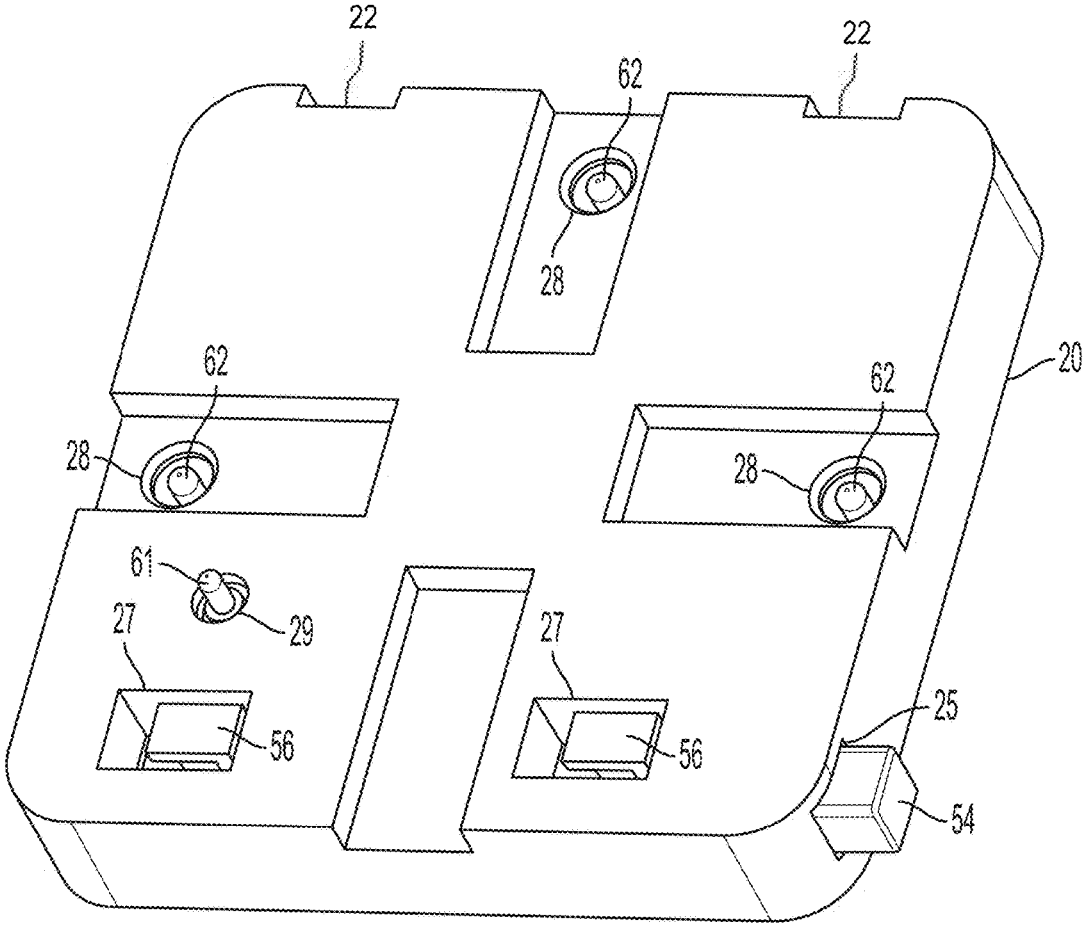
FIG. 2 is a bottom perspective view of the housing of an embodiment of an EAS device with elastic band.

FIG. 2 is a bottom perspective view of housing 20 of an embodiment of EAS device 10 with elastic band. Housing 20 has several apertures in its bottom surface. Latch pockets 27 house latch hooks 56 and are at the bottom of housing 20 to allow interfacing of latch hooks 56 with some of mounting hooks 31 of base 30. At the back of the bottom of housing 20 in FIG. 2 are hook receptacles 22. Hook receptacles 22 are positioned to receive a set of mounting hooks 31 on base 30 to attach housing 20 to base 30. Other apertures are associated with switches. Tamper switch access apertures 28 provide access to tamper switches 62. When housing 20 is attached to base 30, tamper switch access apertures 28 and tamper switches 62 align with spring loaded pins 35 on base 30. When elastic bands 40 are in place, elastic bands 40 compress spring load pins 35 and prevent them from contacting tamper switches 62. Arming switch aperture 29 allows arming switch 61 to extend from inside of housing 20. When housing 20 is attached to base 30, arming switch aperture 29 and arming switch 61 align with switch aperture 32 in base 30. Arming switch 61 is sufficiently long enough to reach all of the way through base 30. This allows arming switch 61 to contact the item to which EAS device 10 is attached. This changes the state of arming switch 61 which indicates that EAS device 10 is attached to an item. Tamper switches 62 and arming switch 61 are in electrical continuity with electronics within housing 20 and the electronics use the state of the switches to determine the status of EAS device 10.

Figure 5:
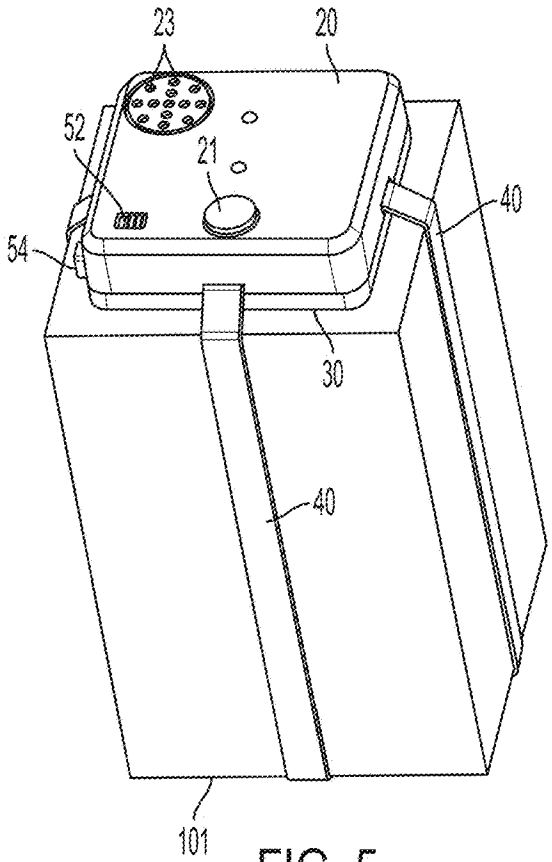
FIG. 5 is a perspective view of an embodiment of an EAS device attached to a box.
Figure 4:
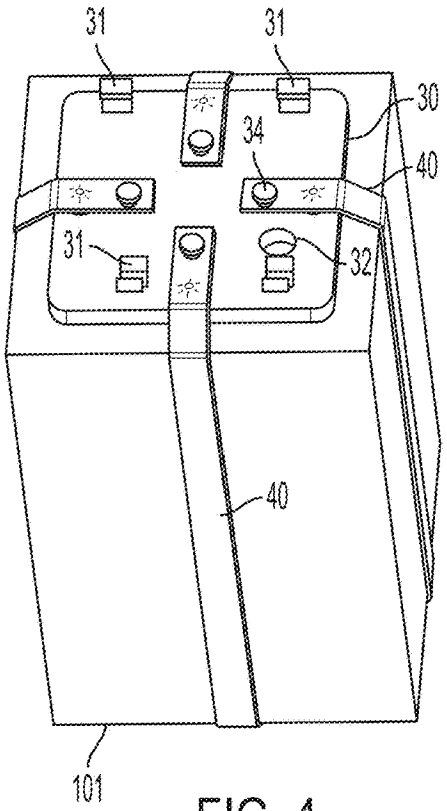
FIG. 4 is a perspective view of a base of an embodiment of an EAS device attached to a box and elastic bands attached to the base and box.
Figure 3:
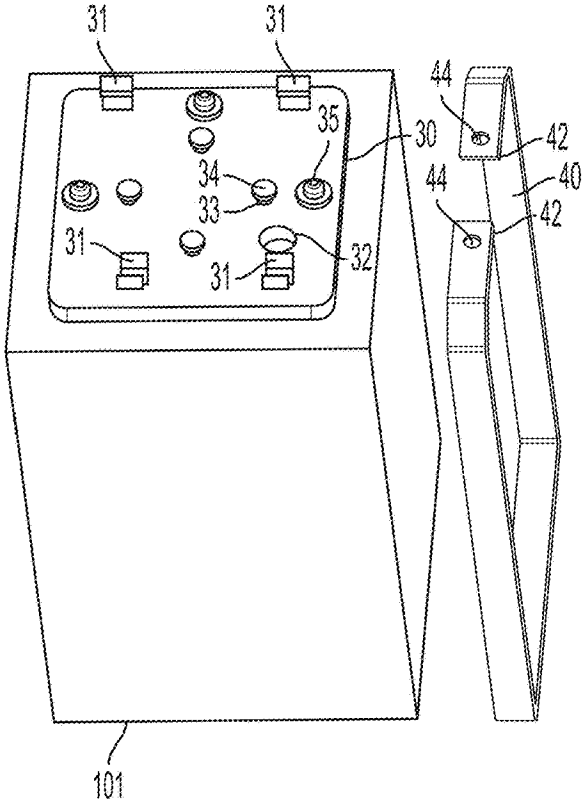
FIG. 3 is a perspective view of a base of an embodiment of an EAS device on a box and an elastic band next to the box.

FIGS. 3-5 illustrate the steps of installing EAS device 10 on an item. FIG. 3 is a perspective view of base 30 of an embodiment of EAS device 10 on a box 101, and elastic band 40 near box 101. FIG. 4 is a perspective view of base 30 of an embodiment of an EAS device 10 attached to a box 101 and elastic bands 40 attached to base 30 and box 101. FIG. 5 is a perspective view of an embodiment of EAS device 10 installed on box 101 with housing 20 attached to base 30, and elastic bands 40 wrapping around box 101. Referring to FIG. 4, elastic bands 40 pass over spring loaded pins 35. The tension in elastic bands 40 provide sufficient force to compress spring loaded pins 35. Referring back to FIG. 2, spring loaded pins 35 align with tamper switch access apertures 28 and tamper switches 62.

Figure 6:
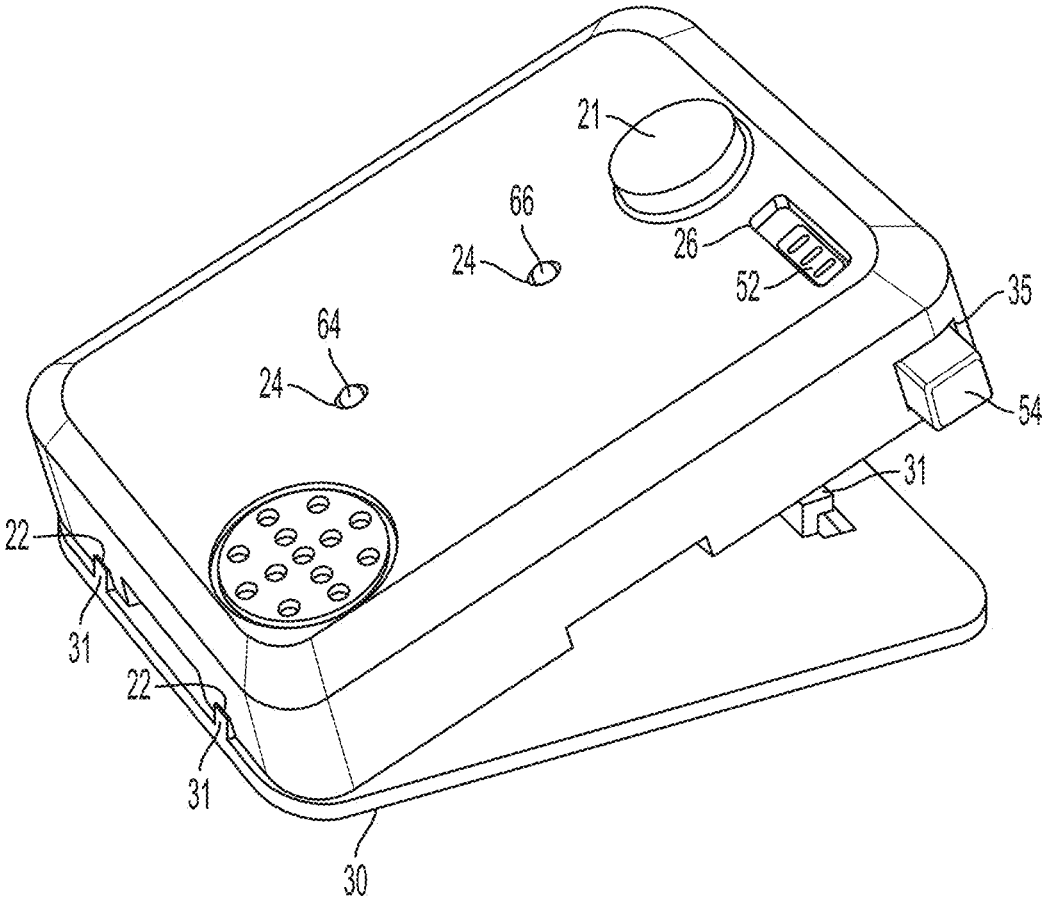
FIG. 6 is perspective view of an embodiment of an EAS device showing the housing hinging onto the base.

FIG. 6 is perspective view of an embodiment of an EAS device 10 showing housing 20 hinging onto base 30. In FIG. 6, a set of mounting hooks 31 on base 30 engage with hook receptacles 22 in housing 20. From this position, housing 20 pivots downward onto base 30 for installation. Once housing 20 is hinged down onto base 30, button 54 can be pushed to slide the latch within housing 20 and engage the latch with complementary hook 31 on base 30. Slide 52 allows the latch to be slid in the opposite direction when EAS device 10 is disarmed and removed from an item.

Figure 8:
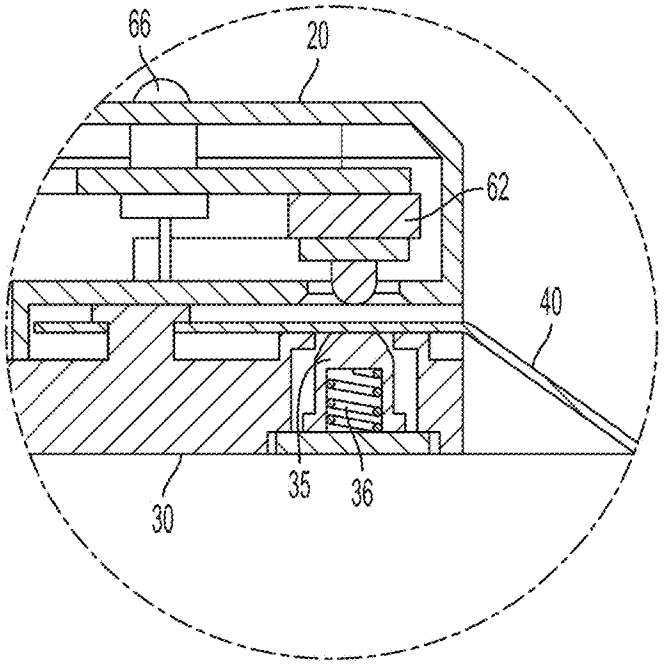
FIG. 8 is an enlargement of the section of FIG. 7 with an elastic band in place.
Figure 7:
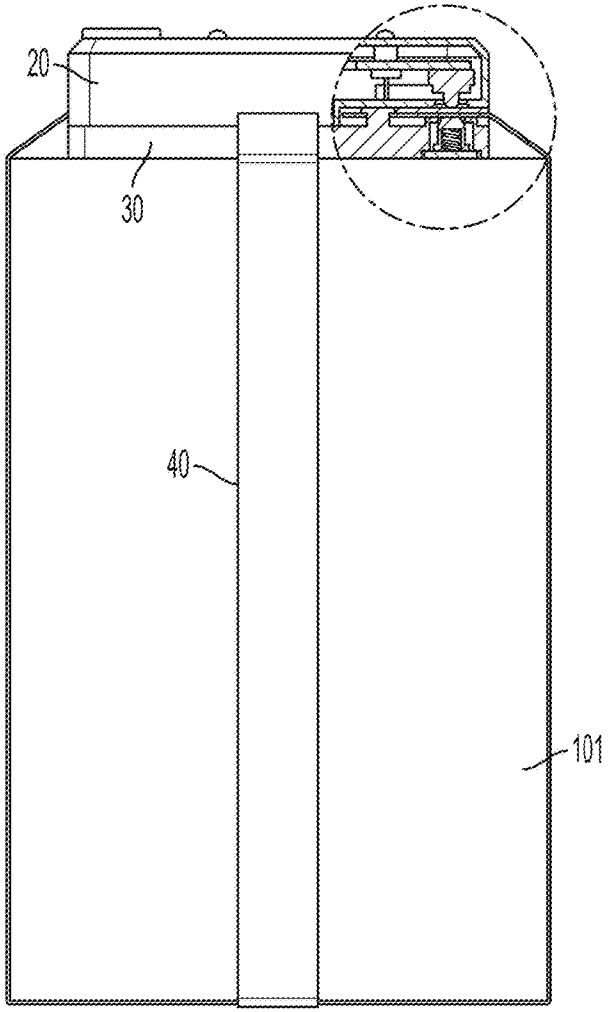
FIG. 7 is a side view of an embodiment of an EAS device attached to a box with a section view of one end of the EAS device.
Figure 9:
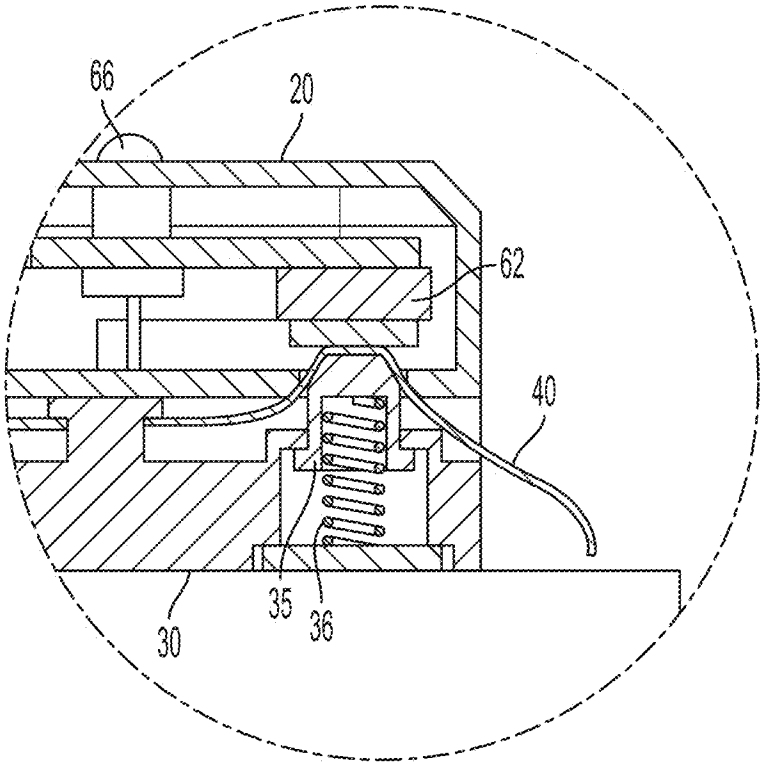
FIG. 9 is an enlargement of the section of FIG. 7 with an elastic band severed.

FIG. 7 is a side view of an embodiment of EAS device 10 attached to a box with a section view of one end of the EAS device 10. FIG. 8 is an enlargement of the section of FIG. 7 with elastic band 40 in place. In FIG. 8, spring 36 biases spring loaded pin 35 upward. However, elastic band 40 compresses spring loaded pin 35 and keeps it from contacting, or actuating, tamper switch 62, which remains fully extended in FIG. 8. FIG. 9 is an enlargement of the section of FIG. 7 with elastic band 40 severed. Being severed, elastic band 40 loses the tension to restrain spring loaded pin 35 which, in FIG. 9, extends and actuates tamper switch 62. This changes the state of tamper switch 62, providing a signal to the electronics within housing 20.

Figure 10:
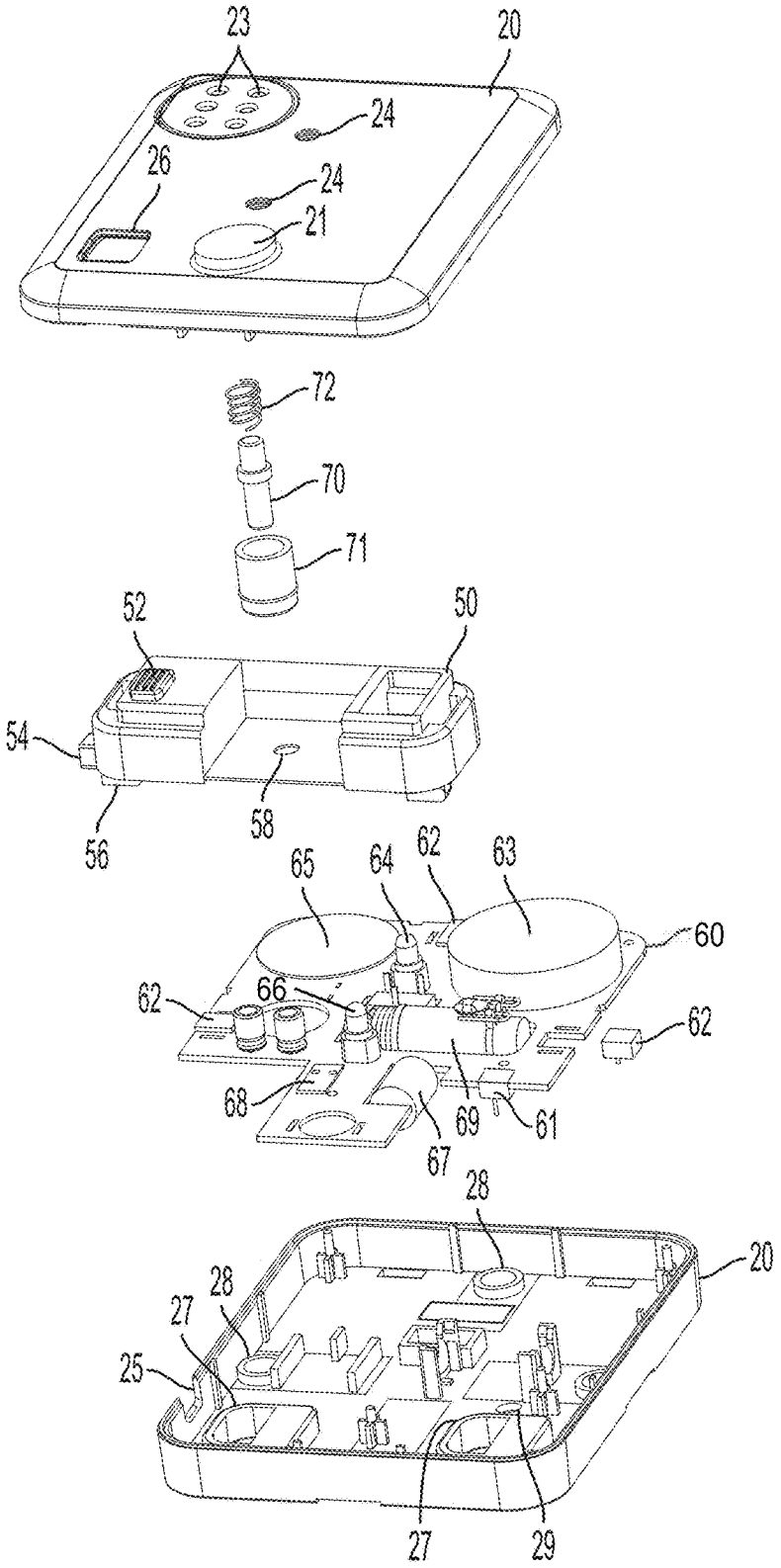
FIG. 10 is an exploded perspective view of a housing of an embodiment of an EAS device.

FIG. 10 is an exploded perspective view of housing 20 of an embodiment of EAS device 10. In FIG. 10, housing 20 is split into an upper and lower shell. In the lower shell, some of the features shown in FIG. 2, such as hook receptacles 22, latch pockets 27, tamper switch access apertures 28, arming switch aperture 29, and button aperture 25, may be seen from the inside of housing 20.

In FIG. 10, circuit board 60 provides a mount for several electronic components, including tamper switches 62 and arming switch 61 which align with their respective apertures when circuit board 60 is in housing 20. Arming switch 61 is visible in FIG. 2, while tamper switches 62 are visible in FIGS. 2, 7, 8 and 9. Other elements that may be housed within EAS device 10 include microprocessor 63, infrared communication port 64, audible alarm generator 65, light emitting diode 66, battery 67, and radio frequency communication circuitry 68, many of which may mount directly to circuit board 60. Some electronic elements on circuit board 60 align with apertures in the top of housing 20. Infrared communication port 64 and light emitting diode 66 align with optical apertures 24, and audible alarm generator 65 aligns with sound apertures 24. Additionally, housing 10 may also carry a core and coil passive electronic article surveillance element 69.

Circuit board 60 and microprocessor 63 are capable of storing machine readable instructions and are programmable to monitor the status of EAS device 10 and to communicate with remote programs and other elements of an EAS system. Circuit board 60 and microprocessor 63 may be programmed or reprogrammed via communication with other elements of an EAS system. In the embodiment shown in FIG. 10, circuit board 60 and microprocessor 63 can communicate via infrared communication port 64 and LED 66 or radio frequency communication circuitry 68 and also receive programming instructions. Audible alarm generator 65 is capable of generating an audible alarm when EAS device 10 is tampered with, for example, in an attempted forced separation of housing 20 and base 30 or by the tearing or cutting of elastic bands 40. If elastic bands 40 lose tension, such as by being cut or torn, spring loaded pins 35 will actuate tamper switches 62, leading to an alarm condition. Audible alarm generator 65 may also be used to indicate the status of EAS device 10 as it is assembled, for example, when arming switch 61 has been actuated through assembly of housing 20 and base 30 onto an object. Similarly, LED 66 can be used to provide visual cues for the status of EAS device 10. Battery 67 generally provides power for the electronic components of EAS device 10.

EAS element 69 is a passive element compatible with prior art EAS systems. These EAS systems generate what is called an interrogation field at a given frequency. These interrogation fields will build up a small amount of stored energy on passive EAS elements brought into the zone. When the interrogation field is turned off and the EAS system listens for a response, the passive EAS elements dissipate their energy and generate a signal at a designed frequency. The EAS system is capable of detecting the signal as an indication of the unauthorized presence of the passive elements and can generate an alarm based on the signal. The EAS elements 69 contained within the embodiment of EAS device 10 in FIG. 10 is compatible with prior art and legacy systems providing an addition security mechanism. In addition to the prior art system detection of the passive EAS element 69, in some embodiments circuit board 60 and microprocessor 63 can monitor the status of passive element 69 and issue an alarm as well. If microprocessor 63 or circuit board 60 detects energy storage and dissipation activity in the coil, then audible alarm generator 65 may be instructed to generate an alarm or the communication capabilities of the electronics may be employed to broadcast a signal to respective receivers in the broader EAS system to generate an alarm.

Still referring to FIG. 10, latch 50 is also located within housing 20, fitting over latch pockets 26. Latch 50 has latch hooks 56 on its bottom and is capable of sliding back and forth within housing 20. Button 54 aligns with button aperture 25 in housing 20, and slide 52 aligns with slide aperture 26 in housing 20. Button 54 and slide 52 are thus externally accessible, allowing slide 50 to be manually moved back and forth to engage and disengage latch hooks 56 with respective complementary mounting hooks 31 on base 30.

Some embodiments of EAS device 10 have a blocking mechanism to keep latch 50 in a latched position once EAS device 10 is installed, and latch 50 is engaged. In the embodiment of FIG. 10, blocking pin 70, cup 71, and spring 72 provide the blocking mechanism to keep latch 50 engaged. Cup 71 keeps blocking pin 70 and spring 72 in position on latch 50, and spring 72 biases blocking pin 70 against latch 50. When latch 50 is moved to engage latch hooks 56 with mounting hooks 31, pin aperture 58 moves into alignment with blocking pin 70, and spring 72 moves blocking pin 70 into pin aperture 58. This provides an automatic blocking mechanism when latch 50 is engaged.

When an authorized person desires to remove EAS device 10 and has disarmed EAS device 10, blocking pin 70 can be moved from its blocking position. Blocking pin 70 is at least partially constructed of magnetically attractable material. Blocking pin 70 aligns with dome 21 in housing 20 which gives an externally visible indication of the location of blocking pin 70. Application of a magnet to dome 21 pulls blocking pin 70 against spring 72 and withdraws blocking pin 70 from pin aperture 58 in latch 50. Latch 50 can then be slid to disengage latch hooks 56 from respective mounting hooks 31. Slide 52 provides the external purchase to manually move latch 50 from the latched position.

Figure 11:
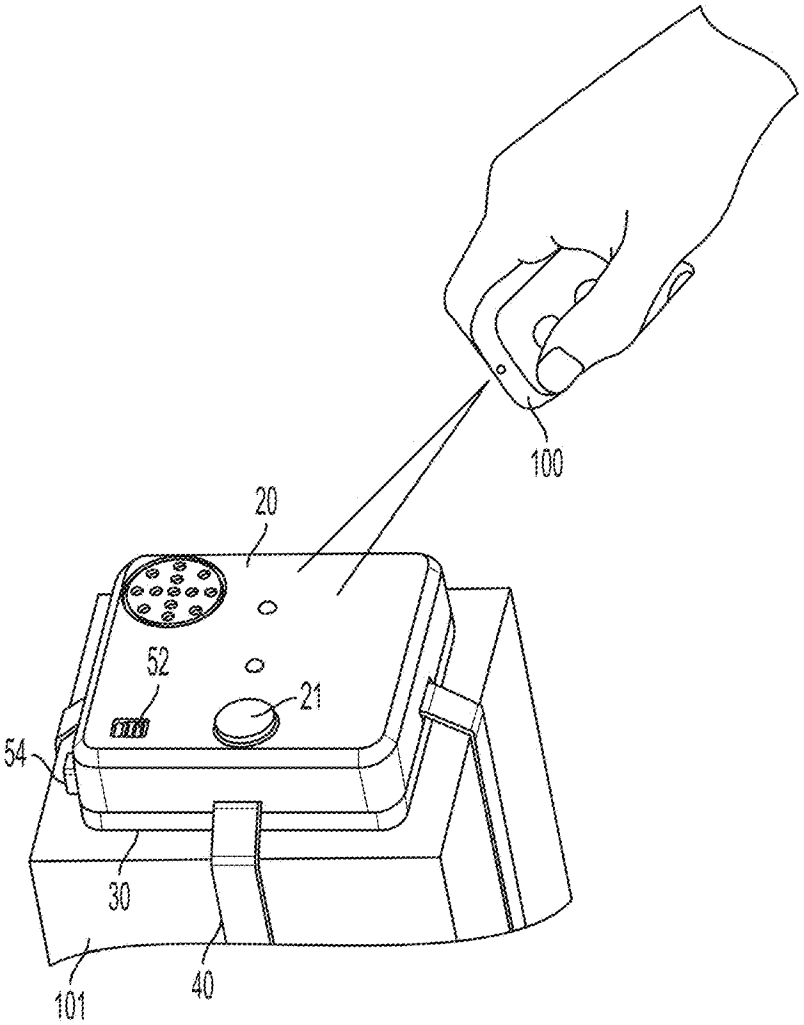
FIG. 11 is a perspective view of an embodiment of an EAS device being armed by an external device.

FIG. 11 is a perspective view of an embodiment of EAS device 10 being armed by external device 100. In FIG. 11, base 30 and elastic bands 40 have been attached to box 101, housing 20 has been attached to base 30, and latch 50 has been engaged. In FIG. 11, button 54 has been pushed to engage latch 50 and slide 52 is moved as well. With EAS device 10 thus installed on box 101, arming switch 61 has contacted box 101 and has had its state changed as a result of that contact. In some embodiments, this is enough to arm EAS device 10. However, in FIG. 11, external device 100 is used to communicate with EAS device 10 to actually arm EAS device 10. External device 100 may wirelessly communicate with EAS device 10 optically, such as via infrared communication port 64 and LED 66, or with wireless signals, such as via radio frequency communication circuitry 68. If not all posts 33 on base 30 are utilized when EAS device 10 is attached to an item 101, i.e. if fewer than the total possible elastic bands 40 are used, this will result in some tamper switches 62 being contacted at the time of installation. The electronics within housing 20 can establish a baseline at the time of arming and account for the number of tamper switches 62 and their individual states.

Once armed, the electronics of EAS device 10 monitors arming switch 61 and tamper switches 62 for changes of state in the switches. If arming switch 61 has a change in state without EAS device 10 being disarmed, the electronics may interpret that as indicating that housing 20 has been detached from the item 101 to which it had been attached. Whether housing 20 and base 30 are still attached to each other or separated from each other, arming switch 61 will still lose contact with box 101. If either of bands 40 are cut or torn to remove EAS device 10 or to gain direct access to the interior of box 101, bands 40 will lose their tension. This will release the respective spring loaded pins 35 and allow them to contact tamper switches 62, changing their state. The electronics of EAS device 10 monitoring tamper switches 62 will register the change in state of tamper switches 62 and determine that EAS device 10 is being tampered with and that an alarm condition exists.

EAS device 10 can communicate an alarm by several means. Audible sound generator 65 may generate an audible alarm to alert persons nearby. EAS device 10 may also communicate an alarm to the broader EAS system with radio frequency communication circuitry 68 or with infrared communication port 64 and LED 66.

Figure 12:
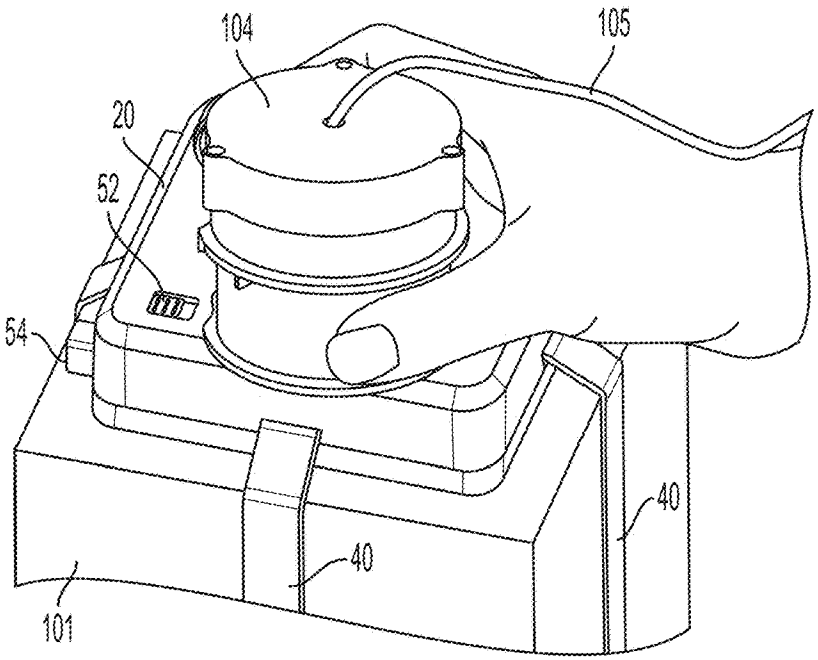
FIG. 12 is a perspective view of an embodiment of an EAS device being detached by application of a magnet.

FIG. 12 is a perspective view of an embodiment of EAS device 10 being detached by application of a magnet 104. In FIG. 12, magnet 104 is combined with an external communication device that is coupled via cable 105 with the larger EAS system. This external communication device can communicate with EAS device 10 and disarm EAS device 10 in the same ways that hand held remote device 100 of FIG. 11 communicates with EAS device 10. Once EAS device 10 is disarmed, magnet 104 is applied to dome 21 of housing 20 (See FIG. 11, and also FIGS. 1, 5, 6, and 10). Referring to FIG. 10, application of magnet 104 to dome 21 attracts blocking pin 70 and withdraws it from pin aperture 58. This allows latch 50 to be disengaged from mounting hooks 31, which allows housing 20 to be disassembled from base 30. In FIG. 12, slide 52 has been moved to the left, disengaging latch 50 which has extended button 54.

Figure 13:
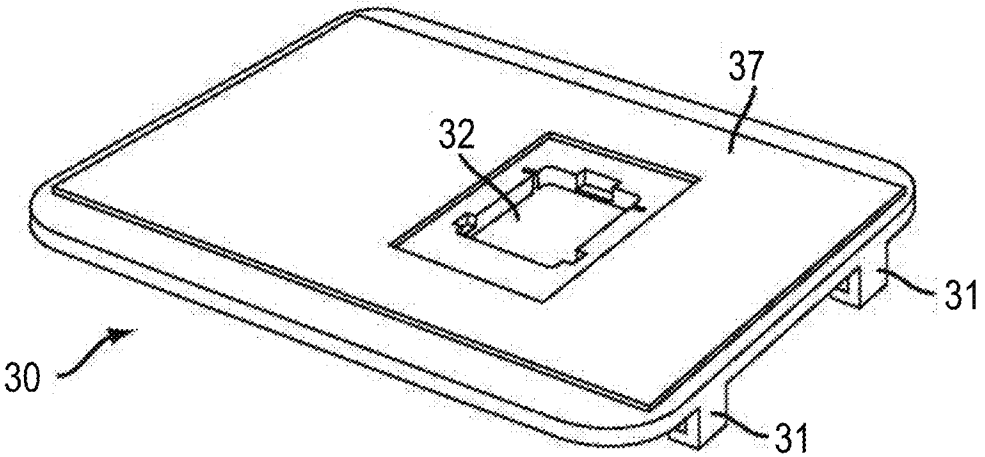
FIG. 13 is a bottom perspective view of an embodiment of a base of an EAS device having an adhesive element on it.

In some applications, elastic bands 40 will be the mechanism by which EAS device 10 is attached to an item. In other applications, embodiments of EAS device 10 may employ supplementary elements to facilitate attachment of EAS device 10 to an item. FIG. 13 is a bottom perspective view of an embodiment of a base 30 of EAS device 10 having adhesive element 37 on it. In the embodiment of FIG. 13, switch aperture 32 is more centered and rectangular shaped. A respective arming switch 61 would be located to align with switch aperture 32. Adhesive element 37 on the bottom of base 30 would assist a user by initially fixing base 30 in place while the user installs elastic bands 40 on base 30. Elastic bands 30 then restrain pins 35 and assist in monitoring the security of installed EAS device 10.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An electronic article surveillance (EAS) device comprising:

a housing comprising a first attaching interface and comprising a top, a bottom, and at least one side connecting said top and bottom of said housing to define an interior of said housing, said bottom of said housing comprising an access aperture;

electronic article surveillance (EAS) electronics located within said interior of said housing, said EAS electronics comprising a tamper switch within said interior, said tamper switch positioned to be accessible through said access aperture;

a base comprising a second attaching interface and comprising a top surface and a bottom surface, said first attaching interface and said second attaching interface being configured to releasably attach said housing to said base with said bottom of said housing facing said top surface of said base, said base comprising a post and a biased pin, each extending from said top surface of said base, said biased pin aligning with said access aperture when said housing is attached to said base; and, an elastic band having a first end and a second end, each end having a post aperture through it; wherein, when said base is attached to an object and said elastic band is wrapped around the object and each post aperture of said elastic band is placed over a post and said housing is attached to said base, said elastic band aligns with said biased pin and restrains said biased pin, preventing said biased pin from contacting said tamper switch in said interior of said housing.

2. The EAS device of claim 1, further comprising:

an adhesive element on said bottom surface of said base, said adhesive element attaching said base to the object.

3. The EAS device of claim 1, wherein:

said base is attached to the object by said elastic band.

4. The EAS device of claim 1, further comprising:

a plurality of access apertures in said bottom of said housing and a plurality of tamper switches in said interior, each said tamper switch aligning with an access aperture;

a plurality of biased pins extending from said top surface of said base, each said biased pin aligning with an access aperture when said housing is attached to said base; wherein, when said base is attached to an object and said elastic band is wrapped around the object and each post aperture of said elastic band is placed over a post and said housing is attached to said base, said elastic band aligns with said biased pins and restrains said biased pins, preventing said biased pins from contacting a respective tamper switch in said interior of said housing.

5. The EAS device of claim 1, further comprising:

a plurality of elastic bands.

6. The EAS device of claim 1, wherein:

said EAS electronics further comprise a microprocessor, wireless communication elements, and a battery; said microprocessor monitoring said tamper switch.

7. The EAS device of claim 5, wherein:

said wireless communication elements comprise radio frequency communication circuitry.

8. The EAS device of claim 5, wherein:

said wireless communication elements comprise an optical port and a light emitting diode.

9. The electronic article surveillance apparatus of claim 1, wherein:

said second attaching interface comprises at least two fixed hooks on said base, and said first attaching interface comprises at least one hook receiving slot in said housing and a latch hook slideably mounted on a sliding latch in said housing, wherein, said at least one hook receiving slot receives a respective fixed hook and said latch hook slideably engages a respective fixed hook to maintain said housing on said base.

10. The electronic article surveillance apparatus of claim 1, wherein:

said EAS electronics further comprise an assembly switch extending from said bottom of said housing; and said base further comprises a switch aperture through said base;

said assembly switch and said switch aperture aligning when said housing is attached to said base.

11. An electronic article surveillance (EAS) device comprising:

a housing comprising a top, a bottom, and at least one side connecting said top and bottom of said housing to define an interior of said housing, said bottom of said housing comprising an access aperture;

electronic article surveillance (EAS) electronics located within said interior of said housing and comprising a tamper switch, said tamper switch positioned to be accessible through said access aperture;

a base comprising a top surface and a bottom surface and a post and a biased pin, said post and biased pin extending from said top surface of said base;

an elastic band having a first end and a second end and a post aperture through each said end;

said housing and base being configured to releasably attach to each other with said bottom of said housing facing said top surface of said base and said biased pin of said base aligning with said access aperture; wherein, when said base is attached to an object and said elastic band is wrapped around the object and each said post aperture is placed over a post and said housing is attached to said base, said elastic band aligns with said bias pin and restrains said bias pin from contacting said tamper switch.

12. The EAS device of claim 11, further comprising:

an adhesive element on said bottom surface of said base, said adhesive element attaching said base to the object.

13. The EAS device of claim 11, said base is attached to the object by said elastic band.

14. The EAS device of claim 11, further comprising:

a plurality of access apertures in said bottom of said housing and a plurality of tamper switches in said interior, each said tamper switch aligning with an access aperture;

a plurality of biased pins extending from said top surface of said base, each said biased pin aligning with an access aperture when said housing is attached to said base; wherein, when said base is attached to an object and said elastic band is wrapped around the object and each post aperture of said elastic band is placed over a post and said housing is attached to said base, said elastic band aligns with said biased pins and restrains said biased pins, preventing said biased pins from contacting a respective tamper switch in said interior of said housing.

15. The EAS device of claim 11, further comprising:

a plurality of elastic bands.

16. The EAS device of claim 11, wherein:

said EAS electronics further comprise a microprocessor, wireless communication elements, and a battery; said microprocessor monitoring said tamper switch.

17. The EAS device of claim 16, wherein:

said wireless communication elements comprise radio frequency communication circuitry.

18. The EAS device of claim 16, wherein:

said wireless communication elements comprise an optical port and a light emitting diode.

19. The electronic article surveillance apparatus of claim 11, wherein:

said housing comprises a first attaching interface and said base comprises a second attaching interface;

said second attaching interface comprises at least two fixed hooks on said base, and said first attaching interface comprises at least one hook receiving slot in said housing and a latch hook slideably mounted on a sliding latch in said housing, wherein, said at least one hook receiving slot receives a respective fixed hook and said latch hook slideably engages a respective fixed hook to maintain said housing on said base.

20. The electronic article surveillance apparatus of claim 11, wherein:

said EAS electronics further comprise an assembly switch extending from said bottom of said housing; and said base further comprises a switch aperture through said base;

said assembly switch and said switch aperture aligning when said housing is attached to said base.

* * * * *